US009282865B2

(12) United States Patent
Moloney et al.

(10) Patent No.: US 9,282,865 B2
(45) Date of Patent: Mar. 15, 2016

(54) CYLINDER VACUUM CLEANER

(75) Inventors: Patrick Joseph William Moloney, Malmesbury (GB); Robert Mark Brett Coulton, Malmesbury (GB); Stuart James Steele, Malmesbury (GB); Rodney James Brown, Malmesbury (GB); James Martin Coleman, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 13/980,822

(22) PCT Filed: Jan. 16, 2012

(86) PCT No.: PCT/GB2012/050081

§ 371 (c)(1), (2), (4) Date: Aug. 8, 2013

(87) PCT Pub. No.: WO2012/098381

PCT Pub. Date: Jul. 26, 2012

(65) Prior Publication Data

US 2013/0305485 A1 Nov. 21, 2013

(30) Foreign Application Priority Data

Jan. 20, 2011 (GB) ..... 1100972.7

(51) Int. Cl.

*A47L 9/00* (2006.01)
*A47L 9/16* (2006.01)
*A47L 5/36* (2006.01)

(52) U.S. Cl.

CPC . *A47L 9/16* (2013.01); *A47L 5/362* (2013.01); *A47L 9/009* (2013.01)

(58) Field of Classification Search

USPC ..... 15/353, 354, 327.2, 327.5; 55/429, 493, 55/DIG. 3; 16/18 R

See application file for complete search history.

(56) References Cited

U.S. PATENT DOCUMENTS

| | | | | |
|---|---|---|---|---|
| 3,375,541 | A * | 4/1968 | Fromknecht | 15/327.2 |
| 3,668,842 | A * | 6/1972 | Batson et al. | 55/417 |
| 3,884,493 | A | 5/1975 | Weir et al. | |
| 5,638,573 | A * | 6/1997 | Martin et al. | 15/327.2 |
| 6,145,160 | A * | 11/2000 | Buss et al. | 15/323 |
| 7,100,236 | B1 * | 9/2006 | Ji | 15/325 |
| 2002/0178532 | A1 * | 12/2002 | Amoretti | 15/327.2 |

(Continued)

FOREIGN PATENT DOCUMENTS

| | | |
|---|---|---|
| CN | 101849794 | 10/2010 |
| EP | 2 409 623 | 1/2012 |

(Continued)

OTHER PUBLICATIONS

Search Report and Written Opinion mailed Mar. 22, 2012, directed to International Application No. PCT/GB2012/050081; 10 pages.

(Continued)

*Primary Examiner* — Dung Van Nguyen

(74) *Attorney, Agent, or Firm* — Morrison & Foerster LLP

(57) ABSTRACT

A cylinder vacuum cleaner comprising a main body which is fluidly connected to a suction hose used to pull the main body forwards along a floor, and a rear swivel castor for supporting the main body on the floor, the rear castor having a negatively-raked swivel axis which is offset from a wheel axis of the castor to provide a positive castor trail.

11 Claims, 9 Drawing Sheets

(56) References Cited

U.S. PATENT DOCUMENTS

| | | | |
|---|---|---|---|
| 2010/0242219 | A1 | 9/2010 | Dyson et al. |
| 2010/0242220 | A1 | 9/2010 | Dyson et al. |
| 2014/0020206 | A1 | 1/2014 | Moloney et al. |
| 2014/0075715 | A1 | 3/2014 | Macnaughton |

FOREIGN PATENT DOCUMENTS

| | | |
|---|---|---|
| GB | 2 333 698 | 8/1999 |
| GB | 2469042 | 10/2010 |
| JP | 7-39482 | 2/1995 |
| NL | 6711520 | 8/1967 |
| WO | WO-99/15346 | 4/1999 |
| WO | WO-01/56449 | 8/2001 |
| WO | WO-03/034888 | 5/2003 |

OTHER PUBLICATIONS

Search Report dated May 11, 2011, directed to GB Application No. 1100972.7; 1 page.

Moloney et al., U.S. Office Action mailed Sep. 5, 2014, directed to U.S. Appl. No. 13/980,824; 6 pages.

* cited by examiner

CYLINDER VACUUM CLEANER

REFERENCE TO RELATED APPLICATIONS

This application is a national stage application under 35 USC 371 of International Application No. PCT/GB2012/050081, filed Jan. 16, 2012, which claims the priority of United Kingdom Application No. 1100972.7, filed Jan. 20, 2011, the entire contents of which are incorporated herein by reference.

FIELD OF THE INVENTION

The present invention relates to a cylinder vacuum cleaner.

BACKGROUND OF THE INVENTION

Vacuum cleaners can broadly be divided into two categories: upright cleaners and cylinder cleaners.

Upright cleaners are pushed along the floor using a handle which is provided at a convenient height for the user (hence the relatively "upright" configuration of the cleaner).

By contrast, cylinder cleaners comprise a main body which is pulled along the floor in use, using a hose which is connected to the main body of the cleaner.

The main body of a cylinder cleaner typically sits either on front and rear swivel castors (casters) or, alternatively, on a combination of swivel castors and fixed wheels, with one or more swivel castors being provided towards the front of the cleaner and a pair of fixed wheels generally being provided towards the rear of the cleaner.

SUMMARY OF THE INVENTION

The present invention provides a cylinder vacuum cleaner having improved maneuverability.

According to the present invention there is provided a cylinder vacuum cleaner comprising a main body which is fluidly connected to a suction hose used to pull the main body forwards along a floor, and a rear swivel castor for supporting the main body on the floor, the rear castor having a negatively-raked swivel axis which is offset from the wheel axis of the castor to provide a positive castor trail.

In the context of the present invention, a negatively-raked swivel axis is one which is tilted forwards specifically, so that the wheel axis is behind the swivel joint (in the nominal direction of travel of the cleaner).

In the context of the present invention, the trail is defined as positive if the swivel axis would strike the floor in front of the contact point between the wheel and the floor.

In conventional cylinder cleaners which use rear castors, the rear castors are designed to have zero rake—they are effectively "free-swiveling" castors. These free-swiveling castors tend to have poorer directional stability than fixed rear wheels, which are better at tracking through turns than the free-swiveling castors. Consequently, free-swiveling castors may compromise maneuverability during normal use.

In conventional cylinders which use fixed rear wheels on the other hand, there is a problem in encountering obstacles in the home, such as a table leg or the corner of a wall. Such obstacles tend to catch the side of the cleaner and exert a lateral force on the cleaner. Fixed wheels, by their nature, are unable to realign themselves with this lateral force. Consequently, unless the traction of the fixed wheels is sufficiently low to allow the wheels to skid laterally—which is often not the case—the cleaner may become jammed against the obstacle (the suction hose cannot be used effectively to push the cleaner backwards in reverse), or else tend to tip over onto its side. This is a recognised benefit of using free-swiveling castors rather than fixed wheels in a conventional cylinder: the free swiveling castors readily allow the lateral movement of the cleaner necessary to prevent jamming of the cleaner against obstacles.

The rear castor of the present invention is a "hybrid" rolling element—neither a true fixed wheel nor a free-swiveling castor, but offering some of the benefit of each. In normal use, the configuration of the rear castor means that the castor is biased by the weight of the main body into a straight line position—and the rear castor thus effectively acts as a fixed wheel. Nevertheless, when the cleaner encounters an obstacle, the rear castor is able to "break out" under sufficient lateral force exerted on the main body, thus acting as a swiveling castor in order to prevent the main body from jamming against obstacles, or tipping over. The passive weight of the main body is used advantageously as a gravitational biasing force to control the rear castors.

Preferably, the hose is connected to the main body in front of the rear castor. This means that the natural tendency is for the main body to tip backwards when it encounters an obstacle. Tipping the main body backwards tends to reduce the rake angle of the swivel axis, so that the rear castor is in a more neutral position—this reduces the weight component of the main body which is directly opposing the swivel action of the castor, making it easier for the castor to swivel. A user may also deliberately tip the main body backwards as required, to control the biasing effect of the main body. This is in contrast to a spring-biased castor, where the biasing force is effectively independent of the position of the main body.

The nominal rake angle of the rear castor is preferably less than 45 degrees. An angle of between 8 and 15 degrees has been found to be particularly effective.

The rear castor may comprise a pair of dome-shaped wheels, which help prevent the castor sinking in thick carpet.

A front castor may be provided for supporting the main body on the floor, the front castor comprising a frame mounted for rotation about a swivel axis and one or more wheels mounted on the frame, the hose being connected to the frame for co-rotation with the frame about the swivel axis.

In a typical conventional cylinder, the hose is attached directly to the main body, the main body is pulled along using the hose and the front castor effectively castors around so that it trails behind the main body as it is pulled along. There is no direct connection between the hose and the front castor. Consequently, in response to changes in the pull direction the cleaner tends to exhibit a degree of inertial 'understeer' as the front castor tries to realign itself with the new pull direction.

In contrast, connecting the hose to the frame of the front castor, for co-rotation about the castor swivel axis S, provides a stable, neutral steering condition for the cleaner. Changes in the pull direction are transmitted through the hose to the front castor, via the swivel-mounted frame. Thus, the front castor co-rotates with the hose about the swivel axis S so that the front castor is always aligned with the pull direction.

The frame is preferably arranged so that it has a positively-raked swivel axis, to further improve steering stability. A "positively-raked" swivel axis is one which is tilted backwards so that the wheel axis of the castor is in front of the swivel joint (in the direction of travel).

The wheels (or wheel) may be arranged to present a rolling support surface which is coincident with a sphere centered on the swivel axis. This helps to prevent the castor from sinking into thick carpet. If the front castor has a positive castor angle then such wheels are particularly advantageous, because they help maintain a constant ride height for the cleaner as the front castor rotates about the swivel axis.

In one embodiment, the frame comprises a duct, the hose is connected to one end of the duct, and the opposite end of the duct is connected to a suction inlet on the main body for rotation about the swivel axis. This is a particularly compact arrangement for fluidly connecting the hose to the main body of the cleaner. The suction inlet may be the inlet to a cyclonic separating chamber. In this case, the front castor may conveniently be arranged below the base of the cyclone chamber with the suction inlet arranged in the base of the cyclone chamber. Thus, dirty airflow passing through the front castor passes directly into the cyclone chamber, which helps reduce pressure losses. The inlet itself may be arranged in the centre of the base of the cyclone chamber, allowing the front castor and cyclone to be arranged conveniently along the centerline of the cleaner. The cyclone chamber itself may be inclined to the vertical (when viewed in side elevation), co-axial with the swivel axis of the front castor, again to minimize pressure losses.

The front castor may comprise a pair of dome-shaped wheels mounted either side of a central frame. These dome-shaped wheels may be banked at a positive camber angle: this helps to maximize the relative separation of the upper portion of the wheels—for example to accommodate the abovementioned duct more easily. At the same time, the relative separation of the floor contact points for the wheels can nevertheless be minimized, which enhances maneuverability.

The cleaner may be provided with a single such front castor and two such rear castors, the front castor being arranged on the centerline of the cleaner and the rear castors being spaced symmetrically either side of the centreline. This sort of arrangement has been found to provide a highly maneuverable cleaner.

BRIEF DESCRIPTION OF THE DRAWINGS

Embodiments of the invention will now be described with reference to the drawings, in which.

DETAILED DESCRIPTION OF THE INVENTION

Figure 1:
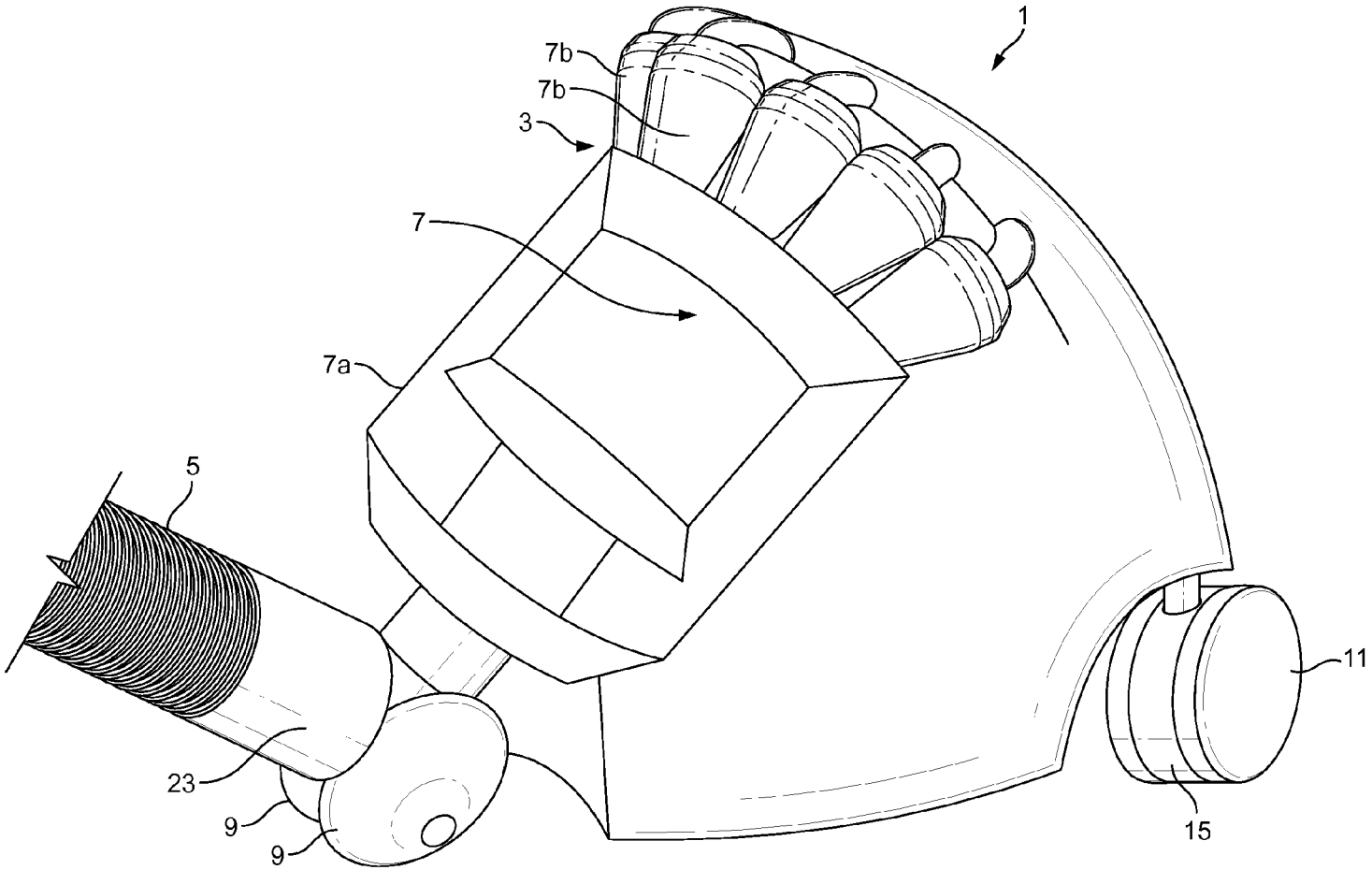
FIG. 1 is a perspective view of a cylinder vacuum cleaner according to the present invention.
Figure 2:
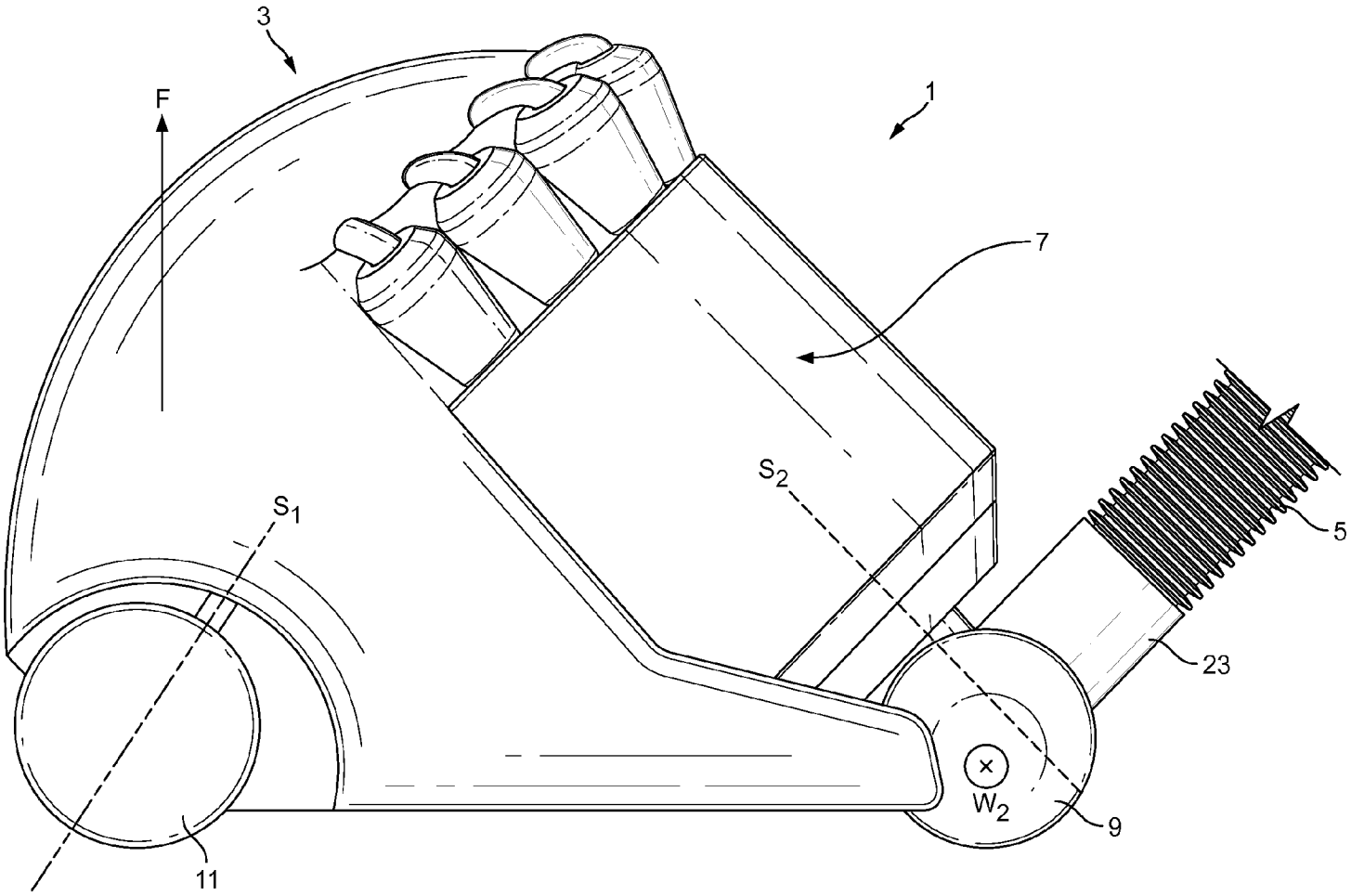
FIG. 2 is a side elevation of the cylinder vacuum cleaner shown in FIG. 1.

FIGS. 1 and 2 show a cylinder cleaner 1 comprising a main body 3 and a hose 5 which connects to the inlet of a cyclonic separating apparatus 7 on the main body 3.

The cleaner 1 operates using a vac-motor onboard the main body 3, which draws dirty air up through the hose 5 and into the cyclonic separating apparatus 7. Inside the separating apparatus 7, the dirty air passes through a series of cyclonic dust separators 7*a*, 7*b* arranged in stages, where dust is removed from the air stream under cyclonic action. After it exits the separating apparatus 7, the relatively clean air is then exhausted back to atmosphere, through the vac-motor.

The cleaner 1 is supported on the floor by a set of three castors, comprising a front swivel castor 9 and two identical rear swivel castors 11 (one visible in FIG. 1, the other visible in FIG. 2). The front swivel castor 9 is arranged on the centerline of the cleaner 1, bisecting the two rear castors 11.

In use, the user drags the main body 3 behind him across the floor, using the hose 5. The hose 5 may be connected at its opposite end to a rigid suction wand and floor tool, making it convenient for the user to reach down to the floor. However, it is not essential for the present invention that the hose 5 connects to a suction wand, save that the hose 5 is used to pull the main body 3 forwards across the floor in use.

The hose 5 has been omitted in some of the Figures for clarity purposes; here, the presence of a hose should nevertheless be assumed.

Rear Castors

Figure 3:
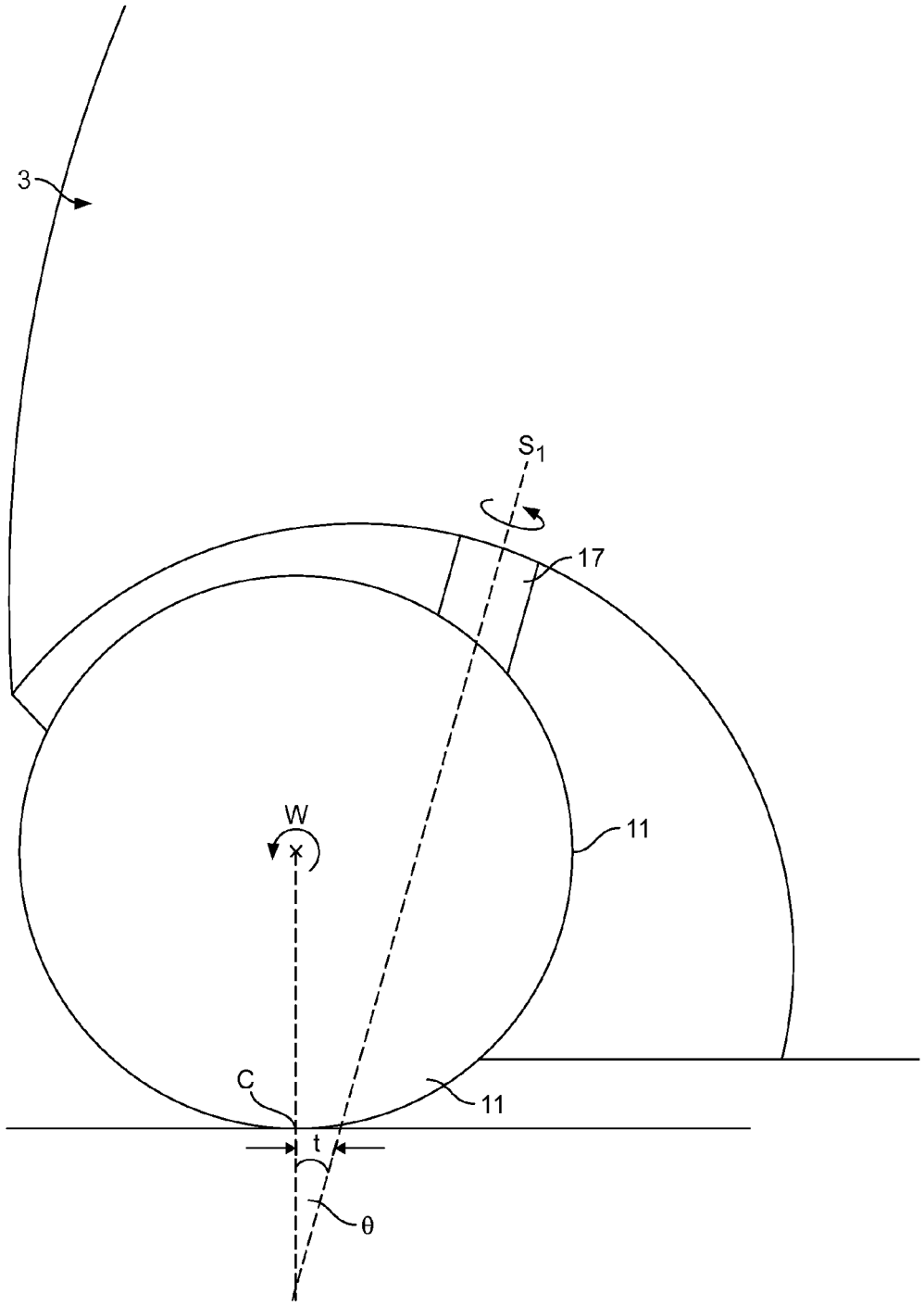
FIG. 3 is an enlarged view of part of a rear part of the cylinder vacuum cleaner in FIG. 2, showing a rear castor in more detail.

FIG. 3 shows one of the rear castors 11 in more detail.

The rear castor 11 comprises a pair of wheels 13 which are rotatably mounted either side of a central frame 15 (see FIG. 1). A central frame is not essential: alternatively for example, the frame could be in the form of a yoke with the wheels mounted between the forks of the yoke. The central frame 15 is in turn rotatably mounted to the main body 3, via a swivel-axle 17, so that it can swivel freely about a swivel axis $S_1$ (but only about the axis $S_1$).

In general, a castor may be characterised by its "rake" and "trail".

"Rake" refers to the angle of the swivel axis relative to the vertical. If a castor has a vertically-extending swivel axis then it has zero rake. Conversely, a non-zero rake implies that the swivel axis is angled to the vertical. In the context of the present invention, a negatively-raked swivel axis is one which is tilted forwards specifically, so that the wheel axis is behind the swivel joint.

"Trail" refers to the horizontal distance between the wheel contact point with the floor and the point at which the swivel axis would strike the floor. If these points coincide then the castor has zero trail, but not otherwise. In the context of the present invention, the trail is defined as positive if the swivel axis would strike the ground in front of the contact point between the wheel and the ground.

The castor 11 is designed and arranged deliberately so that the swivel axis $S_1$ is negatively-raked, simply by appropriately angling the swivel axle 17. At the same time, the castor 11 is designed and arranged so that it nevertheless has a positive trail, t, by offsetting the swivel axis $S_1$ relative to the wheel axis W (FIG. 3). Thus, the swivel axis $S_1$ is tilted forwards (towards the front of the cleaner 1), but nevertheless strikes the floor in front of the contact point C of the wheels 13. A preferred rake angle θ is 8-15 degrees, measured when the cleaner is sitting with the front and rear castors level on a floor.

In conventional cylinder cleaners which use rear castors, the rear castors are designed to have zero rake—they are effectively "free-swiveling" castors. These free-swiveling castors tend to have poorer directional stability than fixed rear wheels, which are better at tracking through turns than the free-swiveling castors. Consequently, free-swiveling castors may compromise maneuverability during normal use.

By contrast, the combination of a negatively-raked swivel axis but a positive castor trail helps to maintain the rear castors 11 in the straight line direction as the cleaner 1 is pulled forwards by the hose 5. This is because rotation of the castors 11 about the swivel axis $S_1$ tends to exert an upward "jacking" force F on the main body 3 (FIG. 2), which is opposed by the (greater) weight of the main body 3. Consequently, in normal use the rear castors 11 tend to behave as directionally-stable, fixed wheels rather than free-swiveling castors: the weight of the main body 3 biases the castors 11 against swiveling movement about the axis $S_1$.

On occasion, the main body of a cylinder cleaner will encounter an obstacle during use. For example, the cleaner may catch on a table leg, or the corner of a wall. In this scenario, a user will typically continue to pull or tug at the hose in an attempt to free the cleaner (it is inconvenient to have to return to the main body of the cleaner each time the main body becomes stuck). In conventional cleaners which utilize fixed rear wheels this can be a problem, because on the one hand the obstacle will tend to exert a lateral force on the main body as the user pulls on the hose, but on the other hand the fixed rear wheels are unable to align themselves with this lateral force. Consequently, unless the traction of the fixed wheels is sufficiently low to allow the wheels to skid laterally—which is often not the case—the cleaner will become jammed against the obstacle, or else tend to tip over onto its side. This is a recognised benefit of using free-swiveling castors rather than fixed wheels in a conventional cylinder: the free swiveling castors readily allow the lateral movement of the main body of the cleaner necessary to prevent jamming of the cleaner against obstacles.

Figure 4:
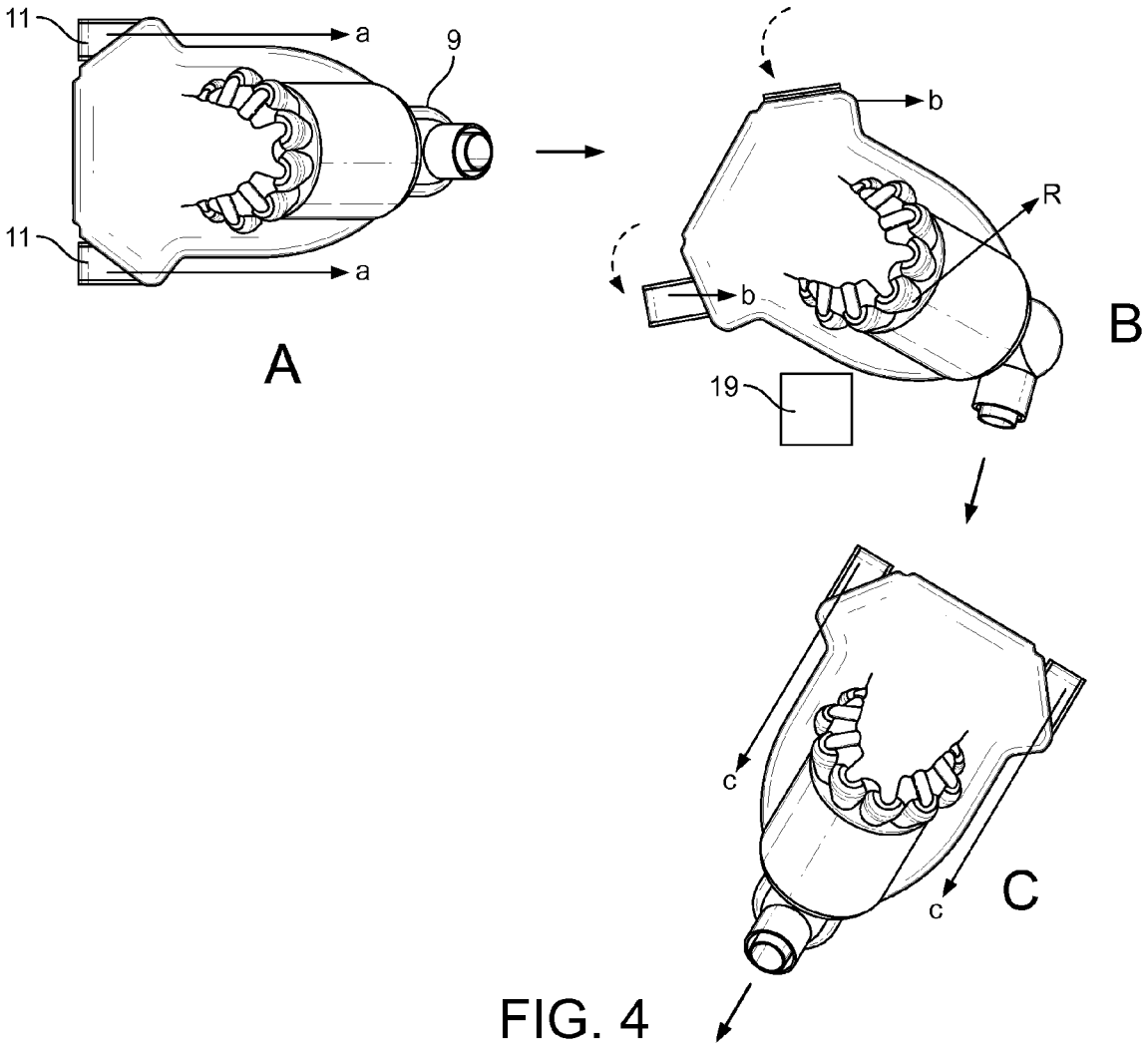
FIG. 4 is a schematic plan view illustrating the cylinder vacuum cleaner encountering an obstacle in use.

FIG. 4 illustrates what happens when the main body 3 of the cleaner 1 encounters an obstacle 19 (the hose 5 has been omitted for clarity). Initially, in the position A, the rear castors 11 are acting effectively as fixed wheels: they are tracking in a stable, straight line behind the front castor 9, under the weight of the main body 3. When the main body 3 catches on the obstacle 19 (position B in FIG. 4), subsequent pulling or tugging on the hose 5 causes the obstacle 19 to exert a lateral reaction force R on the cleaner 1 which wants to push the cleaner 1 out away from the obstacle. At this point, a conventional fixed wheel arrangement would struggle to cope, and the cleaner would likely tip over sideways. However, the rear castors 11 do not behave like conventional fixed wheels. Instead, provided the user pulls hard enough on the hose 5, the lateral force exerted by the obstacle will be enough to force the rear castors 11 to swivel against the opposing weight of the main body 3, thus allowing the rear end of the cleaner 1 to 'swing out' and break away from the obstacle 19.

The rear castors 11 are thus effectively hybrid rolling elements—they are neither fixed wheels nor free-swiveling castors, but advantageously combine elements of both. In normal use, the rear castors 11 adopt a fixed wheel position under the biasing weight of the main body 3 of the cleaner 1, giving the cleaner 1 good directional stability. On the other hand, when the cleaner 1 catches an obstacle, the rear castors 11 are capable of swiveling against the biasing weight of the main body 3 so that the rear end of the main body 3 is able to swing out, away from the obstacle. The arrows a, b and c shows the relative travel direction of the castors 11 in the respective positions A, B and C.

The rear castors 11 default to the fixed wheel position. Thus, once the cleaner 1 has broken away from the obstacle, the weight of the main body once again biases the rear castors 11 into the fixed wheel position (position C in FIG. 3).

Figure 5:
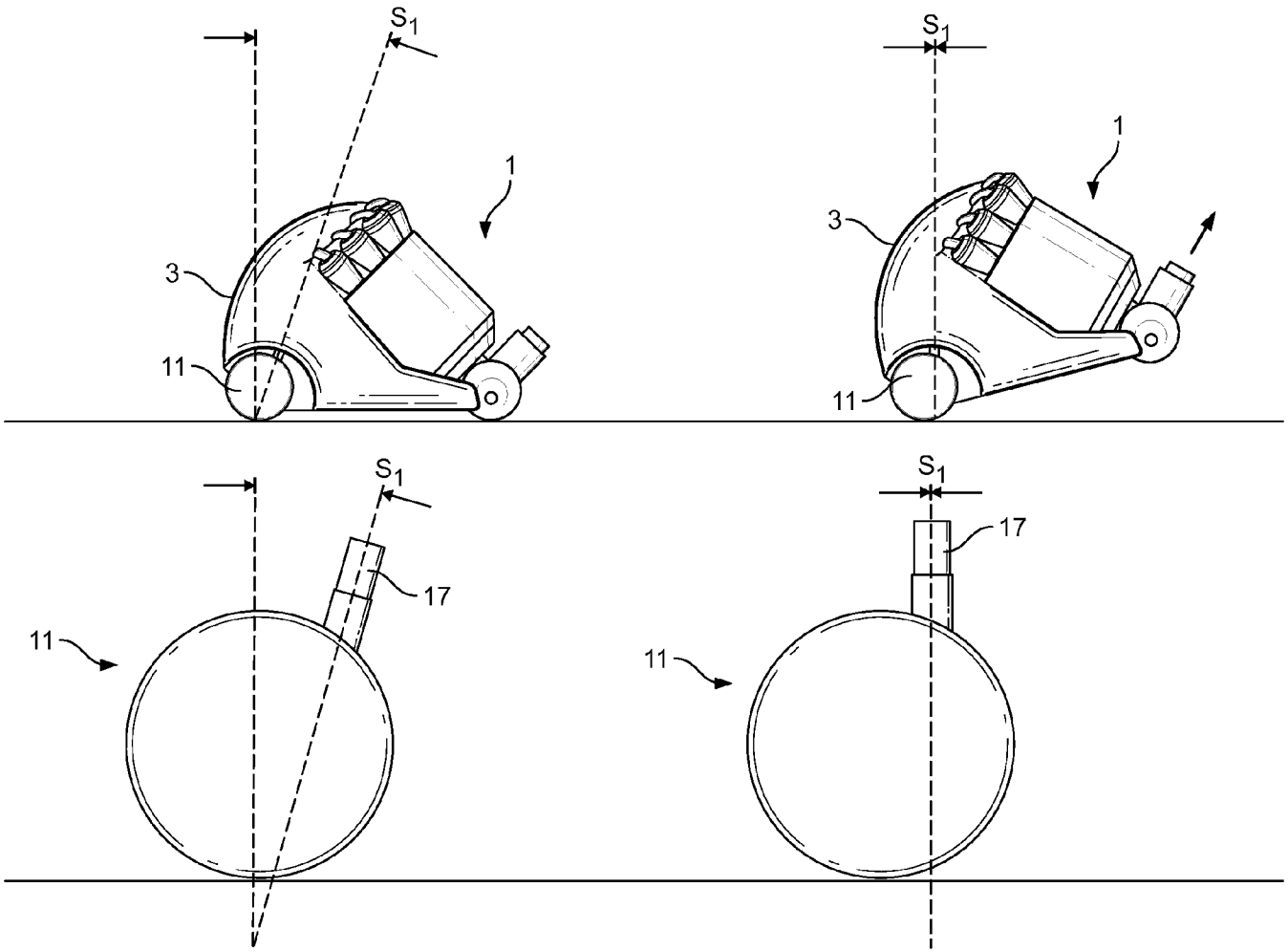
FIG. 5 is composite schematic view showing, across the top, the cylinder cleaner in a level position and tipped backwards and, across the bottom, the respective orientation of the rear castor in each case.

The tendency is for the front of the main body 3 to lift as the user pulls on the hose 5. Lifting the front of the main body 3—effectively tipping the main body backwards on the rear castors 11—reduces the rake angle of the swivel axis $S_1$, so the swivel axis is in a more neutral position (see FIG. 5). This in turn reduces the jacking effect as the rear castors 11 are swiveled, so that the rear castors are able to swivel more easily against the opposing weight of the main body 3. In other words, the biasing effect of the main body 3 on the rear castors 11 actually reduces as the main body is 3 tipped backwards.

When the cleaner 1 catches on an obstacle, the natural tendency for the main body 3 to tip backwards as the user pulls on the hose 5 advantageously reduces the rake of the swivel axis $S_1$, so the rear castors 11 are able to swivel more easily. At the same time, the biasing effect of the weight of the main body 3 is not significantly compromised or reduced in normal use, because the front of the main body 3 will generally be on the floor in normal use, with any lifting of the front end of the cleaner being occasional and/or short in duration.

Figure 6:
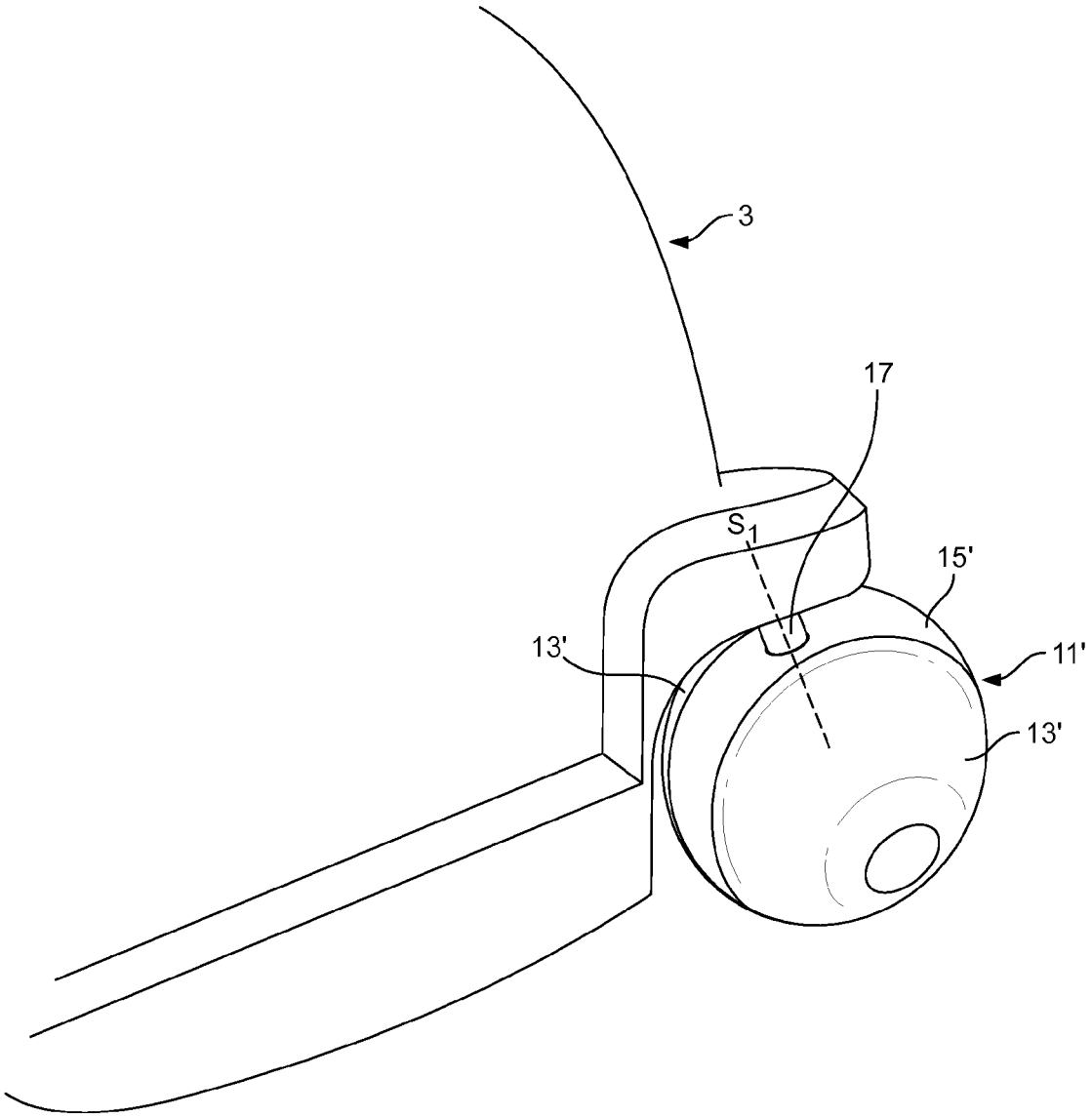
FIG. 6 is a schematic, perspective view of the 'rear corner' of a cylinder vacuum cleaner in accordance with the present invention, showing an alternative type of castor which may be used.

FIG. 6 shows an alternative form for the rear castors (the rear corner of the cleaner is shown in FIG. 6: the main body 3 of the cleaner is pointed to the left, similar to FIG. 1). Here, the rear castor 11' incorporates dome-shaped wheels 13'—mounted either side of a respective frame 15'—to help prevent them from sinking into thick carpet.

The rear castors 11, 11' may be damped in conventional manner to reduce caster flutter, for example using washers to increase the friction between bearing surfaces at the castor swivel joint.

Front Castor

The basic arrangement of the front castor 9 is shown in FIGS. 1 and 2.

The front castor 9 comprises a pair of dome-shaped wheels 21 (one visible in FIG. 2, the other visible in FIG. 1) rotatably mounted either side of a right-angle duct 23. The duct 23 is in turn mounted to the main body 3 for swiveling movement about a swivel axis $S_2$. Thus, the duct 23 acts as a central frame of the front castor 9, analogous to the central frame 15 of each rear castor 11 (see FIG. 1).

The hose 5 is fluidly connected to the front end of the duct 23 via a conventional push-fit connector 25 (FIG. 6) which engages a mating push-fit connector on the hose 5. Thus, the hose 5 is connected to the front castor 9 for co-rotation about the swivel axis, $S_2$.

In a typical conventional cylinder, the hose is attached directly to the main body, the main body is pulled along using the hose and the front castor effectively castors around so that it trails behind the main body as it is pulled along. There is no direct connection between the hose and the front castor. Consequently, in response to changes in the pull direction the cleaner tends to exhibit a degree of inertial 'understeer' as the front castor tries to realign itself with the new pull direction.

Figure 7:
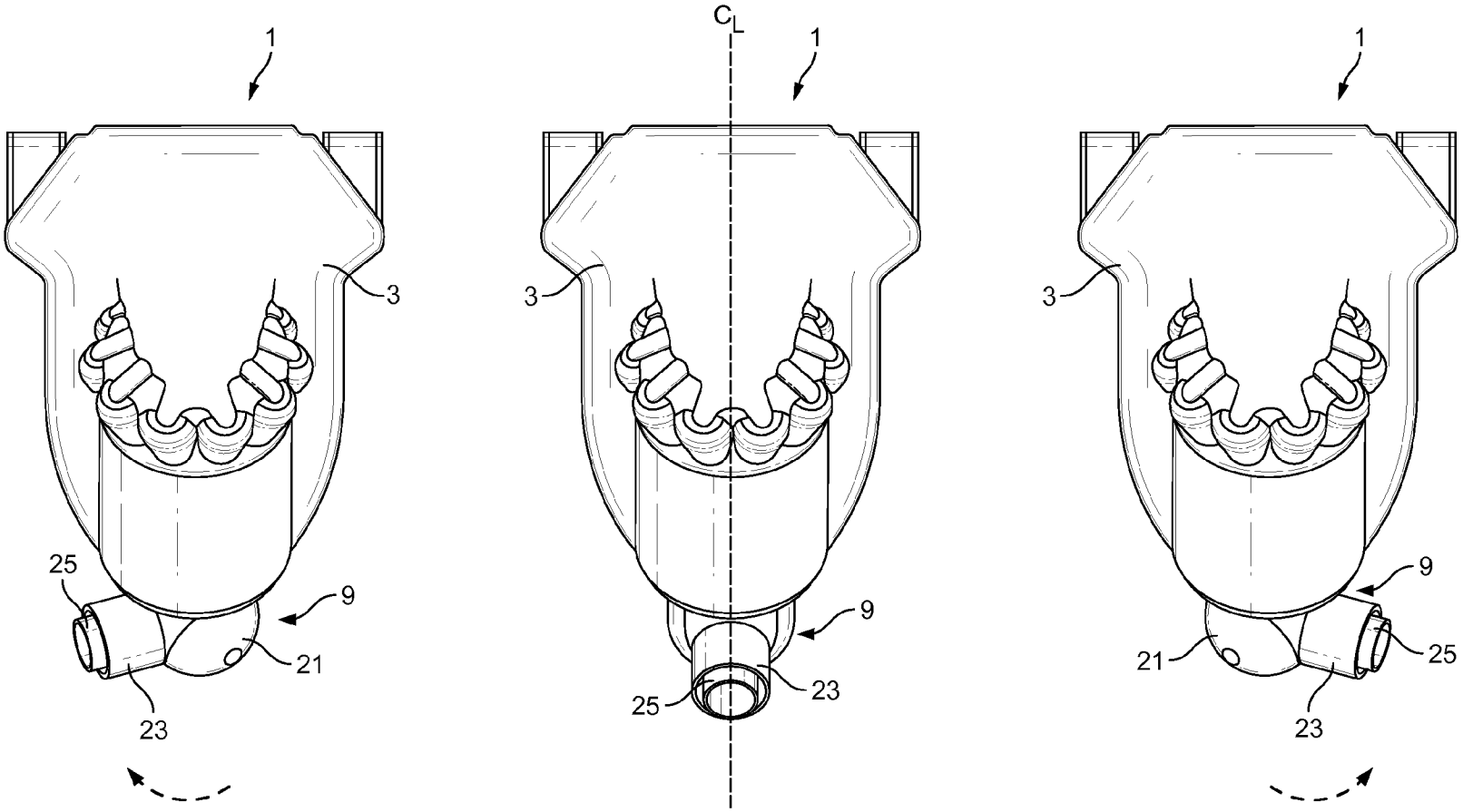
FIG. 7 is a plan view illustrating swiveling movement of the front castor on the same cylinder vacuum cleaner.

In contrast, connecting the hose 5 directly to the front castor 9 for co-rotation about the castor swivel axis $S_2$ provides a stable, neutral steering condition for the cleaner 1. Changes in the pull direction are transmitted through the hose 5 directly to the front castor 9, which co-rotates with the hose 5 about the swivel axis $S_2$ so that the front castor 9 is always aligned with the pull direction. This is illustrated in FIG. 7.

Figure 8:
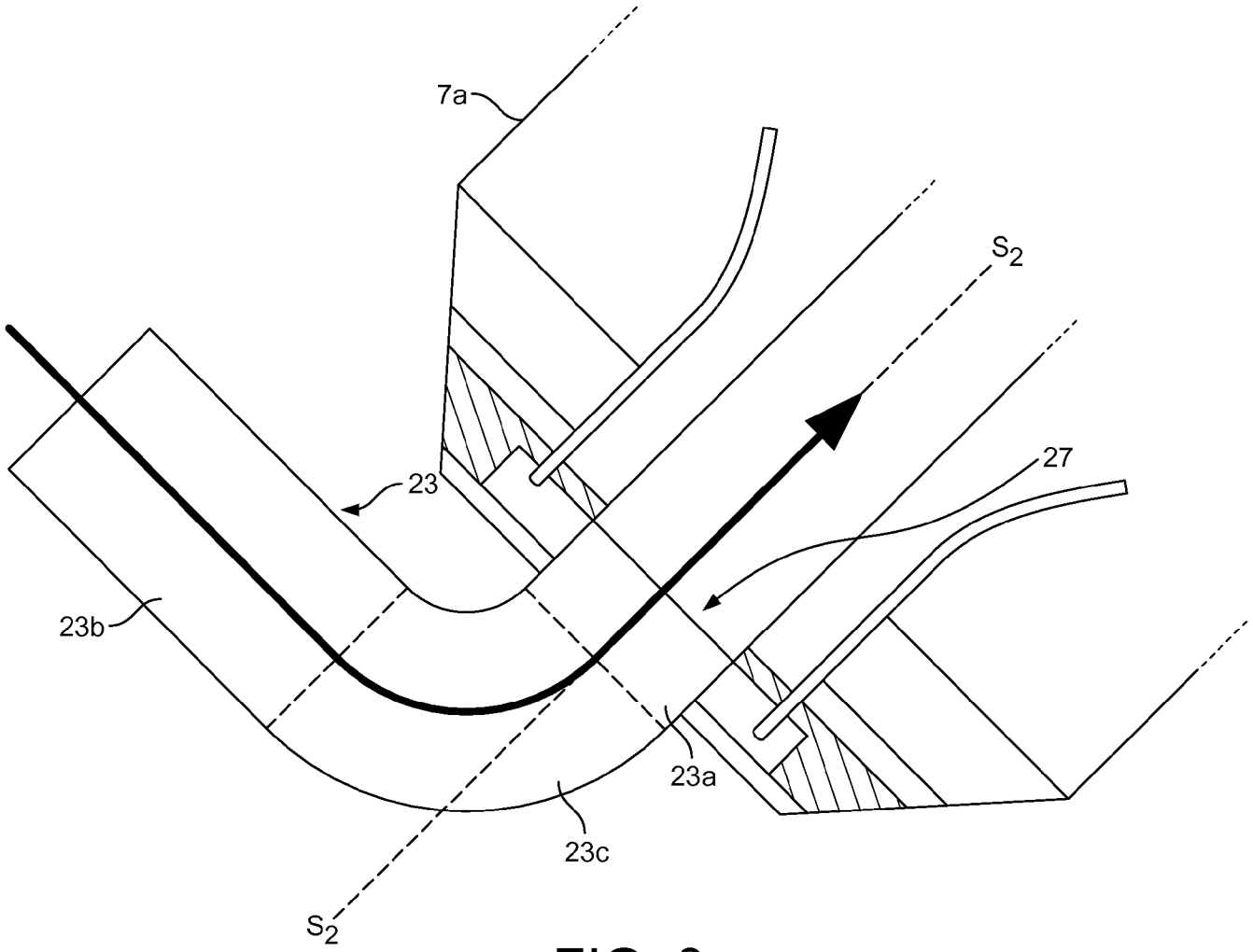
FIG. 8 is a cross section through a front part of the cylinder vacuum cleaner, showing the internal structure of the front castor.

The arrangement of the duct 23 is shown in more detail in FIG. 8. Here, the wheels 21 and push-fit connector 25 at the front end of the duct have been omitted for clarity. The duct 23 connects the hose 5 to a suction inlet on the main body 3, in this case the inlet 27 to a cyclone chamber forming the first stage separator 7*a*. The inlet 27 is arranged centrally in the base of the cyclone chamber 7*a* to allow for convenient positioning of the front castor 9 and cyclone chamber 7*a* along the centerline of the cleaner 1, with the front castor below the base of the cyclone chamber 7*a* (FIG. 7). The flow entering the inlet 27 along the centre of the cyclone chamber can be turned appropriately using, for example, suitable ducting, and/or a conventional baffle(s) or scrolled ramp (not shown) to impart the required cyclonic flow trajectory inside the cyclone chamber.

The duct 23 comprises a rear duct portion 23*a* which extends co-axial with the swivel axis S, a front duct portion 23*b* which extends perpendicular to the swivel axis, and an elbow portion 23*c* which joins the rear duct portion 23*a* to the front duct portion 23*b*.

The rear duct portion 23*a* is connected to the suction inlet 27 for rotation about the swivel axis $S_2$, for example using a conventional circlip arrangement (not illustrated in FIG. 8). This provides the swiveling movement of the front castor 9 about the swivel axis $S_2$.

The front duct portion 23*b* connects to the hose 5 via the push fit connector 25. Thus, the hose 5 is effectively fluidly connected to the suction inlet 27 through the central frame—duct 23—of the front castor 9 (the dirty airflow through the castor is indicated by the arrow in FIG. 7). This is a particularly compact arrangement.

The front castor 9 has a positively-raked swivel axis, meaning that the swivel axis, $S_2$, is tilted backwards so that the wheel axis $W_2$ of the front castor 9 (FIG. 2) is in front of the respective swivel joint of the castor (between the rear duct portion 23*a* and the suction inlet 27).

The curvature of each of the dome-shaped wheels 21 is spherical. Moreover, the wheels 21 are arranged so that the surfaces of the wheels 21 are coincident with a common sphere centered on the swivel axis $S_2$ (see FIG. 9). This helps to maintain a constant ride height for the cleaner 1 as the front castor 9 swivels about the swivel axis.

Figure 9:
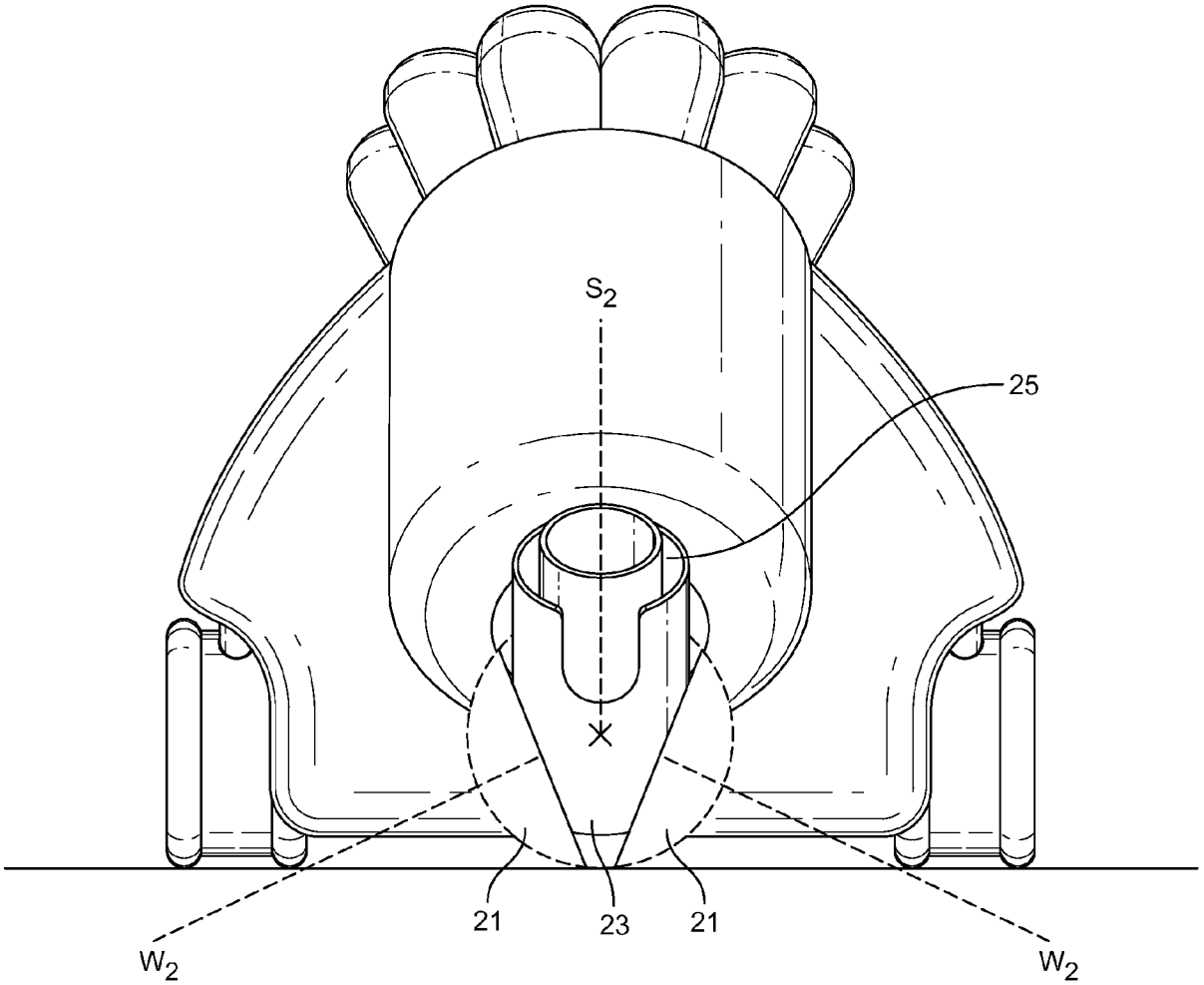
FIG. 9 is a front elevation of the cylinder vacuum cleaner in the previous Figures, illustrating more details of the front castor.

The wheels 21 are mounted on stub axles (not visible) either side of the duct 23. These stub axles are each angled downwardly to set the respective wheel at a corresponding fixed, positive camber angle. The camber angle is the same for each of the wheels 21, so that the wheels form a "V" when viewed from the front (FIG. 9). This has the advantage that the diameter of the duct 23 can easily be accommodated between the wheels 21—reducing the overall height of the front castor 9—yet without the penalty of an increased relative separation of the wheels 21 at the contact point with the floor.

The precise structure of the front castor may vary considerably within the scope of the invention.

For example, the duct 23 may run inside a central frame which has an external shape similar to the frame 15' in FIG. 6, so that the front castor 9 consequently has a ball-shape similar to the rear castor 11'.

A central frame is not essential for the front castor: alternatively for example, the frame could be a yoke (or yoke-like) with the wheels mounted between the forks of the yoke. A duct may be incorporated into the yoke itself to connect the hose to a suction inlet on the main body, analogous to running the duct 23 through a central frame.

Use of an intermediate duct fluidly to connect the hose to the main body is not essential. For example, the hose may instead be connected directly to a suction inlet on the main body. A conventional circlip arrangement may be used to provide the necessary rotation of the hose relative to the suction inlet—similar to the connection between the duct 23 and inlet 27—and the frame may in turn be mounted concentrically on the main body for co-rotation with the hose about a common swivel axis.

The invention claimed is:

1. A cylinder vacuum cleaner comprising a main body which is fluidly connected to a suction hose used to pull the main body forwards along a floor, a rear swivel castor for supporting the main body on the floor, the rear castor having a negatively-raked swivel axis which is offset from a wheel axis of the castor by a first rake angle to provide a positive castor trail, the rear swivel castor having swivel movement during operation of the vacuum cleaner, and a front castor with a further swivel axis which is offset from the wheel axis of the castor by a second rake angle different from the first rake angle of the negatively-raked swivel axis of the rear castor.

2. The cylinder vacuum cleaner of claim 1, wherein the nominal rake angle of the rear castor is between 8 and 15 degrees.

3. The cylinder vacuum cleaner of claim 1, wherein the rear castor comprises a pair of dome-shaped wheels.

4. The cylinder vacuum cleaner of claim 1, wherein the hose connects to the main body in front of the rear castor.

5. The cylinder vacuum cleaner of claim 1, further comprising a front castor for supporting the main body on the floor, the front castor comprising a frame mounted for rotation about a further swivel axis and one or more wheels mounted on the frame, the hose being connected to the frame for co-rotation with the frame about the further swivel axis.

6. The cylinder vacuum cleaner of claim 5, wherein the frame is arranged to have a positively-raked swivel axis.

7. The cylinder vacuum cleaner of claim 5, wherein the wheel or wheels present a rolling support surface which is coincident with a sphere centered on the further swivel axis.

8. The cylinder vacuum cleaner of claim 5, wherein the frame comprises a duct, the hose being connected to one end of the duct, the opposite end of the duct being connected to a suction inlet on the main body for rotation about the further swivel axis.

9. The cylinder vacuum cleaner of claim 8, wherein the suction inlet is the inlet to a cyclonic separating chamber.

10. The cylinder vacuum cleaner of claim 9, wherein the front castor is arranged below a base of the chamber and the suction inlet is in the base of the chamber.

11. The cylinder vacuum cleaner of claim 5, comprising a single such front castor and two such rear castors, the front castor being arranged on the centerline of the cleaner and the rear castors being spaced symmetrically either side of the centreline.

* * * * *